US011390477B2

(12) United States Patent
Rutherford

(10) Patent No.: US 11,390,477 B2
(45) Date of Patent: Jul. 19, 2022

(54) MEDIA DESKEW APPARATUS AND DESKEW METHODS

(71) Applicant: NCR Corporation, Atlanta, GA (US)

(72) Inventor: Craig Rutherford, Blairgowrie (GB)

(73) Assignee: NCR Corporation, Atlanta, GA (US)

( * ) Notice: Subject to any disclaimer, the term of this patent is extended or adjusted under 35 U.S.C. 154(b) by 248 days.

(21) Appl. No.: 16/586,228

(22) Filed: Sep. 27, 2019

(65) Prior Publication Data

US 2021/0094780 A1 Apr. 1, 2021

(51) Int. Cl.

| | |
|---|---|
| ***B65H 9/10*** | (2006.01) |
| ***B65H 9/00*** | (2006.01) |
| ***B65H 9/16*** | (2006.01) |

(52) U.S. Cl.

CPC ..... *B65H 9/004* (2013.01); *B65H 9/101* (2013.01); *B65H 9/106* (2013.01); *B65H 9/166* (2013.01)

(58) Field of Classification Search

CPC ..... B65H 5/068; B65H 9/106; B65H 9/166; B65H 9/10

See application file for complete search history.

(56) References Cited

U.S. PATENT DOCUMENTS

| | | | | |
|---|---|---|---|---|
| 5,257,777 | A * | 11/1993 | Kalika | B65H 3/04 271/259 |
| 6,267,372 | B1 * | 7/2001 | Mylaeus | B65H 3/063 271/226 |
| 6,398,204 | B1 * | 6/2002 | Keane | B65H 31/06 198/405 |
| 7,735,818 | B2 * | 6/2010 | Fournier | B65H 1/06 271/2 |
| 9,617,099 | B2 * | 4/2017 | Jang | G07D 11/17 |
| 9,764,915 | B2 * | 9/2017 | Muhl | B65H 3/0638 |
| 9,969,583 | B2 * | 5/2018 | Widsten | B65H 5/062 |
| 10,294,050 | B2 * | 5/2019 | Pond | G06Q 20/20 |
| 10,370,212 | B1 * | 8/2019 | Atwood | B65H 9/166 |
| 10,913,628 | B2 * | 2/2021 | Widsten | B65H 9/14 |

* cited by examiner

*Primary Examiner* — Howard J Sanders
(74) *Attorney, Agent, or Firm* — Schwegman, Lundberg & Woessner

(57) ABSTRACT

A bunch of valuable media items are transported along a track surface within a deskew/pick module of a depository until a bottom item of the bunch covers a track sensor adjacent to an exit. Upper rollers are disengaged from a topmost item of the bunch and lower track-surface rollers are rotated in a direction that is perpendicular to a sidewall forcing a bottommost item of the bunch in alignment to the sidewall. Upper rollers are lowered onto the topmost item and pick rollers are activated to urge the bottommost item through the exit of the module. Upper rollers are raised off the topmost item and lower track-surface rollers are rotated; upper rollers are lowered onto the topmost item and pick rollers are activated to urge a next bottommost item through the exit. This process is repeated until no items are left in the bunch to process.

6 Claims, 10 Drawing Sheets

MEDIA DESKEW APPARATUS AND DESKEW METHODS

BACKGROUND

Currency recyclers and depositories generally include note separators to separate stacks of notes before being processed by a deskew module that deskews each note for further downstream processing, such as imaging.

Generally, the media separator performs two functions: separating a single media item from a bunch of media items and then using a deskew module to properly align the separated media item within the depository for transport and further downstream processing within the depository.

Conventional approaches rely on spring loaded upper rollers that are hard and inflexible, the spring allows for an upper force to maintain contact with the bunch prior to separation and entry into the conventional deskew module. The deskew module includes multiple different solenoids or motors and multiple driveshafts. This is necessary because the media is driven in two or more directions straight and angled. Furthermore, a variety of optical sensors are necessary to identify positions of the media for purposes of activating the appropriate drivers during media alignment. The media itself is also driven along the transport path through the deskew module along a belt mechanism. Because of the belt transport mechanism, the straight-line drivers and angular-drivers are oriented above or on top of the media as the media is being aligned within the deskew module.

As a result, there is a sizeable number of electromechanical components and sensors needed within the deskew module to achieve proper media alignment, which adds costs and complexities to the deskew module. The length of the transport path is also believed to be optimal based on the needed componentry and what is known about the maximum size of a media item that may need to be aligned within the deskew module.

A media depository performs a variety of media-based functions; typically, each function requires a separate electromechanical module. Because of the complexities associated with deskewing a media item, the industry has separated the process of separating a media item from a bunch (media separator) from the process associated with deskewing the media item (deskew module).

Consequently, depositories tend to have a larger than is necessary physical footprint, which makes it difficult to install depositories in some retail locations where physical space is limited or non-existent to accommodate traditional depositories, or which prohibits adding additional functionality into the depository because of space-based limitations.

SUMMARY

In various embodiments, methods for deskewing media within a valuable media depository and a media deskew module for the valuable media depository are provided.

According to an aspect presented herein, a method for deskewing valuable media within a deskew module is presented. Specifically, a leading edge of a media item is detected as being proximate to an exit of a deskew module. A first side edge of the media item is urged in a direction that is perpendicular to a direction of travel of the media item through the deskew module and a second side edge of the media item is forced in a second direction against a wall of the deskew module. The leading edge of the media item is pulled through the exit of the deskew module.

According to another aspect presented herein, a method for deskewing valuable media within a deskew module is presented. More particularly, a stack of media items are detected adjacent to an exit of a deskew module. Rollers are rotated in a direction that is perpendicular to a direction of travel of the stack through the deskew module and a bottom media item of the stack is forced into alignment against a wall of the deskew module. The bottom media item is urged through the exit of the deskew module. The process iterates back to the rotating of the rollers for a next bottom media item until a last media item of the stack is urged through the exit.

In still another aspect presented herein, a deskew module is presented. The deskew module includes: a lower track surface, upper rollers situated above the lower track surface, lower rollers located under flush at first portions of the lower track surface, deskew rollers recessed beneath second portions of the lower track surface, and pick rollers situated adjacent to an exit of the deskew apparatus. The upper rollers are configured to lower onto a topmost item of a stack of media items upon detection a bottommost item of the stack at an entry sensor into the deskew apparatus. The upper rollers and the lower rollers are configured to rotate in a first direction towards an exit of the deskew apparatus upon entry of the bottommost item of the stack into the deskew apparatus to urge the stack towards the exit of the deskew apparatus. The upper rollers and the lower rollers are configured to stop rotating in the first direction when the bottommost item is detected at a second sensor adjacent to the pick rollers, and the upper rollers are configured to raise off of the topmost item when the bottommost item is detected at the second sensor. The deskew rollers are configured to make a complete revolution and rotate in a second direction that is perpendicular to the first direction when the upper rollers and the lower rollers stop rotating to cause the bottommost item to align against a wall of the deskew apparatus. The upper rollers are configured to lower back onto the topmost item of the stack without rotation after the complete revolution of the deskew rollers. The pick rollers are configured to activate after the upper rollers are lowered back onto the topmost item of the stack to grab the bottommost item from the stack and pull the bottommost item through the exit. The upper rollers are configured to lift off the topmost item once the bottommost item is pulled through the exit based on detection of a trailing edge of the bottommost item passing over an exit sensor, and the process iterates back to the deskew rollers rotating until a last item of the stack is pulled through the exit by the pick rollers.

DETAILED DESCRIPTION

Figure 1A:
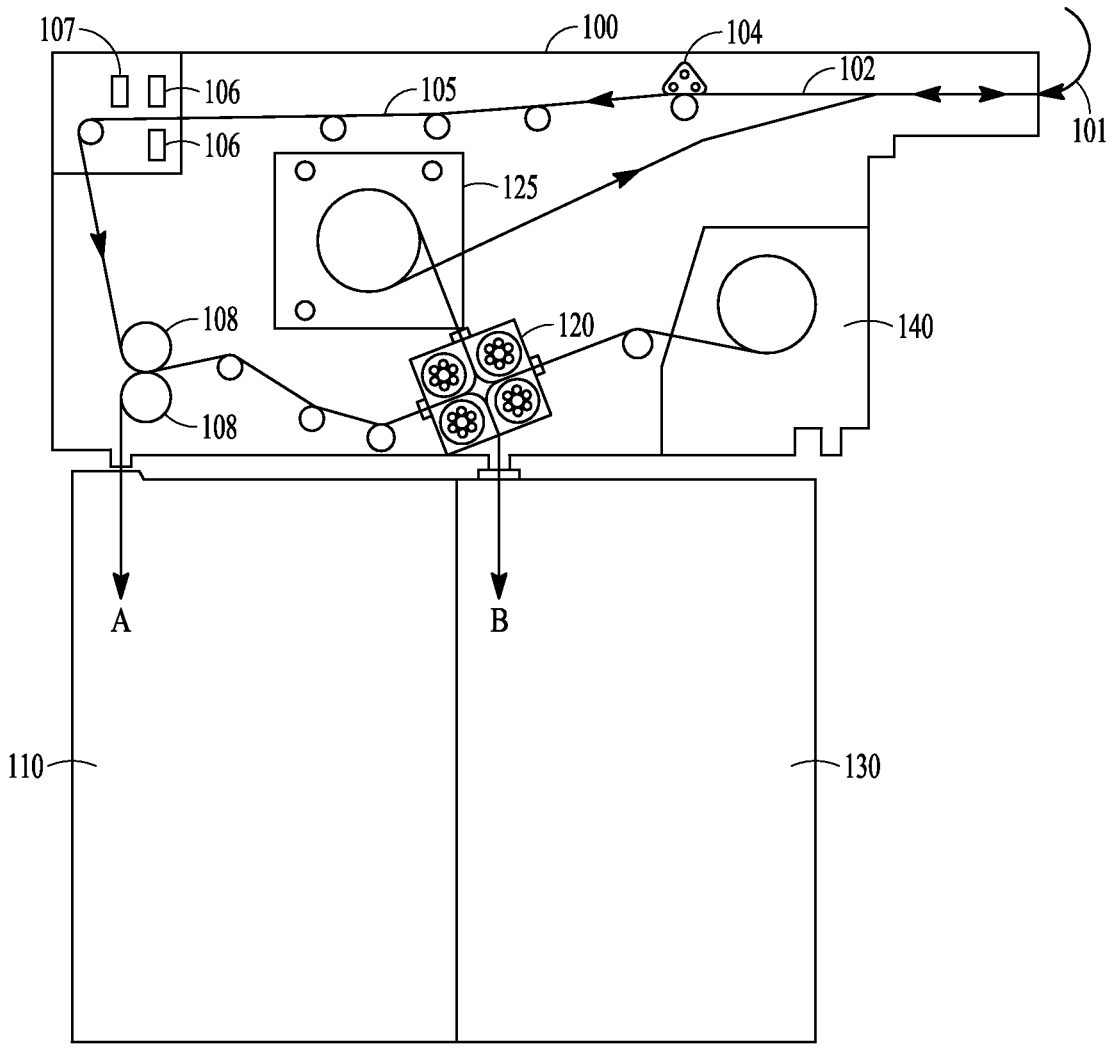
FIG. 1A is a diagram depicting a deposit module of a Self-Service Terminal having a deskew module, according to an example embodiment.

FIG. 1A is a diagram depicting a one-sided view of a valuable media depository 100, according to an example embodiment (also referred to as a deposit module). It is to be noted that the valuable media depository is shown with only those components relevant to understanding what has been added and modified to a conventional depository for purposes of providing deskewing of limp media fed into the depository 100.

Depository 100 is suitable for use within an Automated Teller Machine (ATM), which can be utilized to process deposited banknotes and checks (valuable media as a mixed bunch if desired). Deposit module 100 has an access mouth 101 (media or document infeed) through which incoming checks and/or banknotes are deposited or outgoing checks and/or banknotes are dispensed. Mouth 101 is aligned with an infeed aperture in the fascia of the ATM in which the depository 100 is located, which thus provides an input/output slot to the customer. A bunch (stack) of one or more items (valuable media) is input or output. Incoming checks and/or banknotes follow a first transport path 102 away from mouth 101 in a substantially horizontal direction from right to left shown in the FIG. 1A. They then pass through a novel combined separator and deskew module 104 (hereinafter just "deskew module 104" and discussed in detail below with reference to the FIGS. 1B-1G). A single item of media exits deskew module 104 along another pathway portion 105, which is also substantially horizontal and right to left. With each media item de-skewed and aligned, each media item is read and/or validated by imaging cameras 106 and a Magnetic Ink Character Recognition (MICR) reader 107.

Items are then are directed substantially vertically downwards to a point between two nip rollers 108. Nip rollers 108 cooperate and are rotated in opposite directions with respect to each other to either draw deposited checks and/or banknotes inwards (and urge those checks and/or banknotes towards the right hand side in FIG. 1A), or during another mode of operation, rollers 108 can be rotated in an opposite fashion to direct processed checks and/or banknotes downwards in the direction shown by arrow A in FIG. 1A into a check or banknote bin 110. Incoming checks and/or banknotes, which are moved by nip rollers 108 towards the right, enter a diverter mechanism 120. Diverter mechanism 120 can either divert the incoming checks and/or banknotes upwards (in FIG. 1A) into a re-buncher unit 125, or downwards in the direction of arrow B in FIG. 1A into a cash bin 130, or to the right-hand side shown in FIG. 1A into an escrow 140. Items of media from escrow 140 can selectively be removed from the drum and re-processed after temporary storage. This results in items of media moving from escrow 140 towards the left-hand side of FIG. 1A where again they will enter diverter mechanism 120. Diverter mechanism 120 can be utilized to allow the transported checks and/or banknotes to move substantially unimpeded towards the left-hand side and thus nip rollers 108 or upwards towards re-buncher 125. Currency notes from escrow 140 can be directed to re-buncher 125 or downwards into banknote bin 130.

As used herein, the phrase "valuable media" refers to media of value, such as currency, coupons, checks, negotiable instruments, value tickets, and the like.

For purposes of the discussions that follow with respect to FIGS. 1A-1G, "valuable media" is referred to as "media" and the "valuable media depository" is referred to as a "depository." Additionally, valuable media or media item may be referred to as a "document," "check," "note," and/or "currency" herein.

It is also noted that some dimensions and measurements may be implicitly or explicitly illustrated with the discussions of FIGS. 1B-1G, these dimensions and measurements may be altered without departing from the novel teachings presented herein for deskewing damaged media within a valuable media depository.

As will become apparent with the teachings herein, a novel deskew module 104 allows for both media item separation from a stack of media items and media item deskewing.

That is, what conventionally entailed two separate modules for two separate media functions are now processed in a different manner by a new and novel deskew module 104. The new deskew module 104 allows the length required of the transport pathway 102 (for a conventional media separator and deskew module) to be reduced by approximately 204 mm from a conventional 520 mm to 316 mm. This substantial reduction in track length is achieved without any reduction in functionality and with new functionality (deskewing a media item from a bunch of media items). Deskew module 104 employs less componentry than a conventional deskew module including less: optical sensors, solenoids or motors, belts, skid plates, axles, bearings, transport motors, and drive gears. Furthermore, D-shaped rollers 104E of deskew module 104 allows for proper deskew functionality without use of a conventionally required solenoid to engage and disengage the deskew mechanism. As a result, deskew module achieves enhanced functionality while reducing costs, complexity, and space (footprint) requirements associated with conventional media separators and conventional media deskew modules.

Two functions are achieved by deskew module 104: 1) media separation from a stack or bunch (also referred to herein as media "picking") and 2) media deskewing within depository 100. These functions are achieved in the same track space (area of media transport) and within a same module (deskew module 104). In some cases, the media separation is performed after the media picking (separating), which is a different order for which these two functions are processed from that which has been done and believed to be necessary in the industry (conventionally media item picking (separating) occurs before media item deskewing).

Figure 1B:
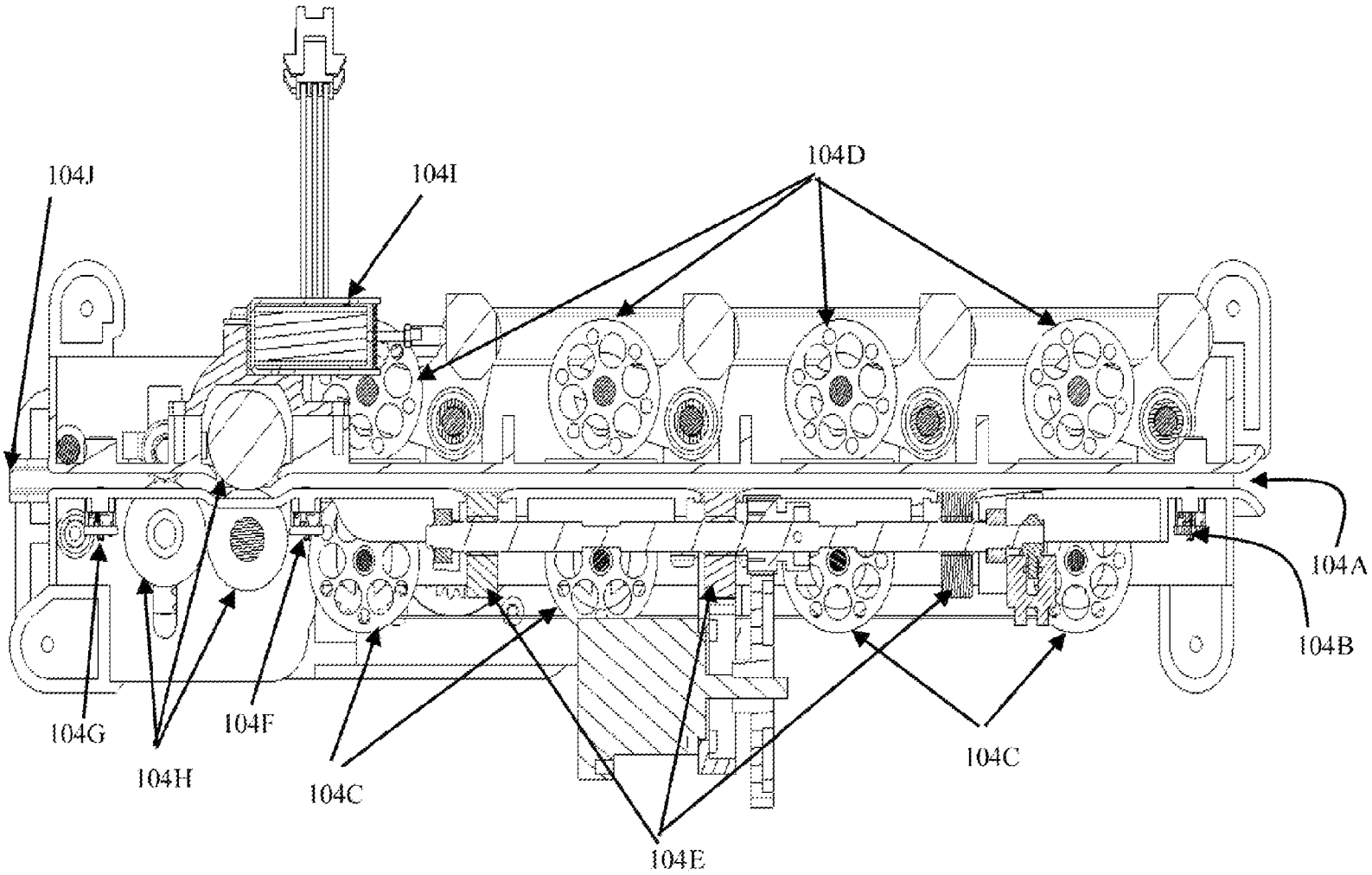
FIG. 1B is a diagram depicting components of a deskew module from a side cross-sectional view, according to an example embodiment.

FIG. 1B is a diagram depicting components of novel deskew module 104 from a side cross-sectional view, according to an example embodiment. It is noted that only those components necessary for understanding novel deskew module 104 are labeled and illustrated, as other components may exist as well but are unnecessary for comprehending the illustrated embodiments presented herein.

Deskew module 104 includes an entry or infeed 104A through which a stack of media items are received onto the transport pathway of deskew module 104. Entry of the stack is detected by a first track sensor 104B. Flexible (silicone based or other flexible material) lower rollers 104C engage a bottom media item on the bottom of the stack and transport the stack through deskew module 104 in a direction toward a media exit 104J. Simultaneously, flexible (silicone based or other flexible material) upper rollers 104D engage the topmost media item of the bunch and rotate in the direction toward media exit 104J. Upper rollers also flex/bend to provide resistance or force (pushing down during rotation on a topmost item of the stack) to maintain the integrity of the stack as lower rollers 104C and upper rollers 104D simultaneously rotate in the direction of media exit 104C.

When a bottom item of the stack covers second track sensor 104F, upper rollers 104D stop rotating and are lifted up and disengage the topmost item of the stack while simultaneously lower rollers 104C stop rotating flush along the track surface. The stack of media items becomes stationary, at this point in time, in front of media pick mechanism 104H.

Next, D-shaped rollers 104E are engaged to rotate in a direction that is perpendicular to the direction of travel of the stack through deskew module 104 and that is perpendicular to a side wall or edge 104*k* (illustrated in FIG. 1D below). D-shaped rollers 104E are biased and in an initial orientation such that the straight-line portion of the D is flush with or just below the surface of the track surface when lower rollers 104C and upper rollers 104D are rotating in the direction of media exit 104J and while the stack is being moved along the track surface. This ensures that rounded portions of D-shaped rollers 104E do not impeded the stack as the stack is moving from entry 104A towards exit 104J. Once lower rollers 104C and upper rollers 104D stop rotating and are recessed and raised, respectively, a single gear motor for 3 positioned D-shaped rollers 104E is activated to rotate a single drive shaft 104M (shown in FIG. 1E). This movement of shaft 104M causes three sets of gears 104L (shown in FIG. 1E) to rotate and lift each D-shaped roller 104E up above a surface of the track forcing rounded portions of each D-shaped roller 104E to engage an edge of at least the bottom media item of the stack and forcing an opposing edge of that media item against a side wall 104K (shown in FIG. 1C), which aligns the bottom media item of the stack against side wall 104*k*.

Because upper rollers 104D are raised when D-rollers 104E make a complete revolution by rotating perpendicular to the direction of travel of the stack (or perpendicular to side wall 104*k*) through deskew module 104, the stack is able to slip and flex freely as D-rollers rotate.

Once a complete revolution of D-rollers 104E has completed, upper rollers 104D are lowered applying downward force onto the topmost item of the stack for stack stability. Upper rollers 104D are lowered via transport roller disengagement solenoid 104I. Pick mechanism rollers 104H are energized and activated to rotate in the direction of media exit 104J. this causes the bottom media item of the stack to be separated from the stack and pulled through toward a third track sensor 104G. Once the picked or separated media item has passed third track sensor 104G, pick mechanism rollers 104H are stopped indicating that the picked media item has exited deskew module 104 through media exit 104J and is being processed by other downstream modules of depository 100.

Next, upper transport rollers 104D are raised and disengaged from a topmost item of the stack, D-rollers 104E are rotated a full revolution, upper transport rollers 104D are lowered back on to the topmost item of the stack through solenoid 104I, pick mechanism rollers 104H are rotated towards media exit 104J, and a next bottom item of the stack is pulled through media exit 104J. This process repeats until there are no media items left in the stack (which is detectable when no media item is covering second track sensor 104F).

It is noted that a controller connected to deskew module 104 allows for activation, deactivation, raising, and lowering of rollers 104C, 104D, 104H and rotation of D-rollers 104E. The controller includes firmware and/or software residing in a non-transitory computer-readable storage medium as executable instructions that when processed by a processor of depository 100 allows for detection of covered and uncovered sensors 104B, 104F, and 104G, and corresponding activation and deactivation (including raising and lowering) of rollers 104C, 104D, 104E, and 104H (which entails activation/deactivation of motors or solenoid 104I). That is, a circuit board within the valuable media depository 100 includes component circuitry and firmware programmed to selectively activate and deactivate the electromechanical components of deskew module 104 based on signal received from track sensors 104B, 104F, and 104G and timings or signals associated with a completed rotation of D-shaped rollers 104E.

Figure 1C:
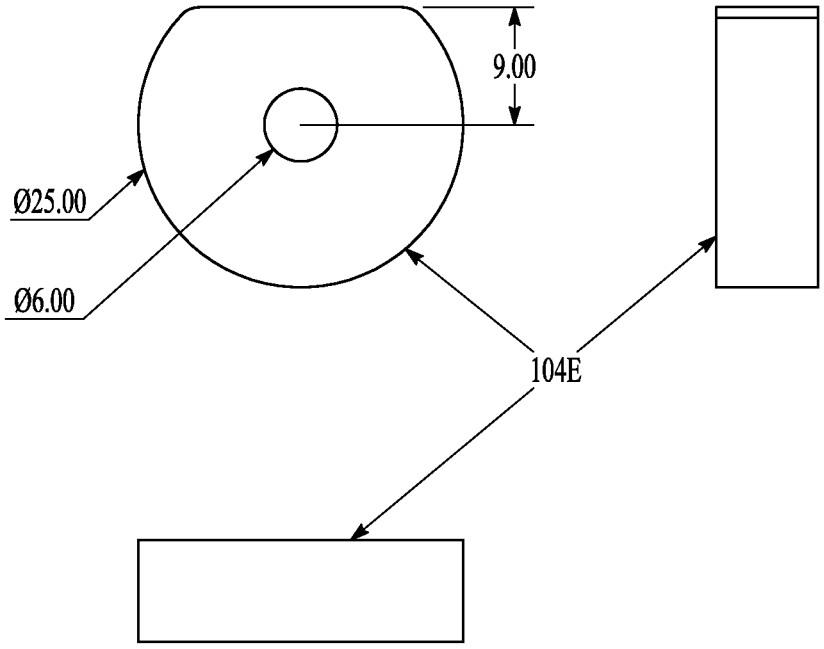
FIG. 1C is are diagrams depicting views of a D-shaped roller component of the deskew module, according to an example embodiment.

FIG. 1C is are diagrams depicting views of a D-shaped roller 104E component of the deskew module 104, according to an example embodiment.

The topmost left image illustrates the D-shaped roller 104E in a biased position where the straight-line edge of the D-shaped roller 104E is flush with the track surface of deskew module 104. The aperture (hole) of the D-shaped roller 104E includes a circumference of approximately 6 mm. The distance from the center of the aperture to the straight-line edge is approximately 9 mm. The circumference of the rounded portions of the D-shaped roller 104E is approximately 25 mm. The D-shaped roller 104E is rotated in a direction that is perpendicular to sidewall 104K of deskew module 104 from the aperture (or hole portion of the D-shaped roller 104E).

The topmost right image illustrates a width (thickness) of the D-shaped roller 104E as approximately 8 mm and illustrates a view of D-shaped roller 104E when it is rotated such that the straight-line portion of the D-shaped roller 104E is perpendicular to the track surface. The bottommost image illustrates the D-shaped roller 104E from another side view with the straight-line edge facing forward.

Figure 1D:
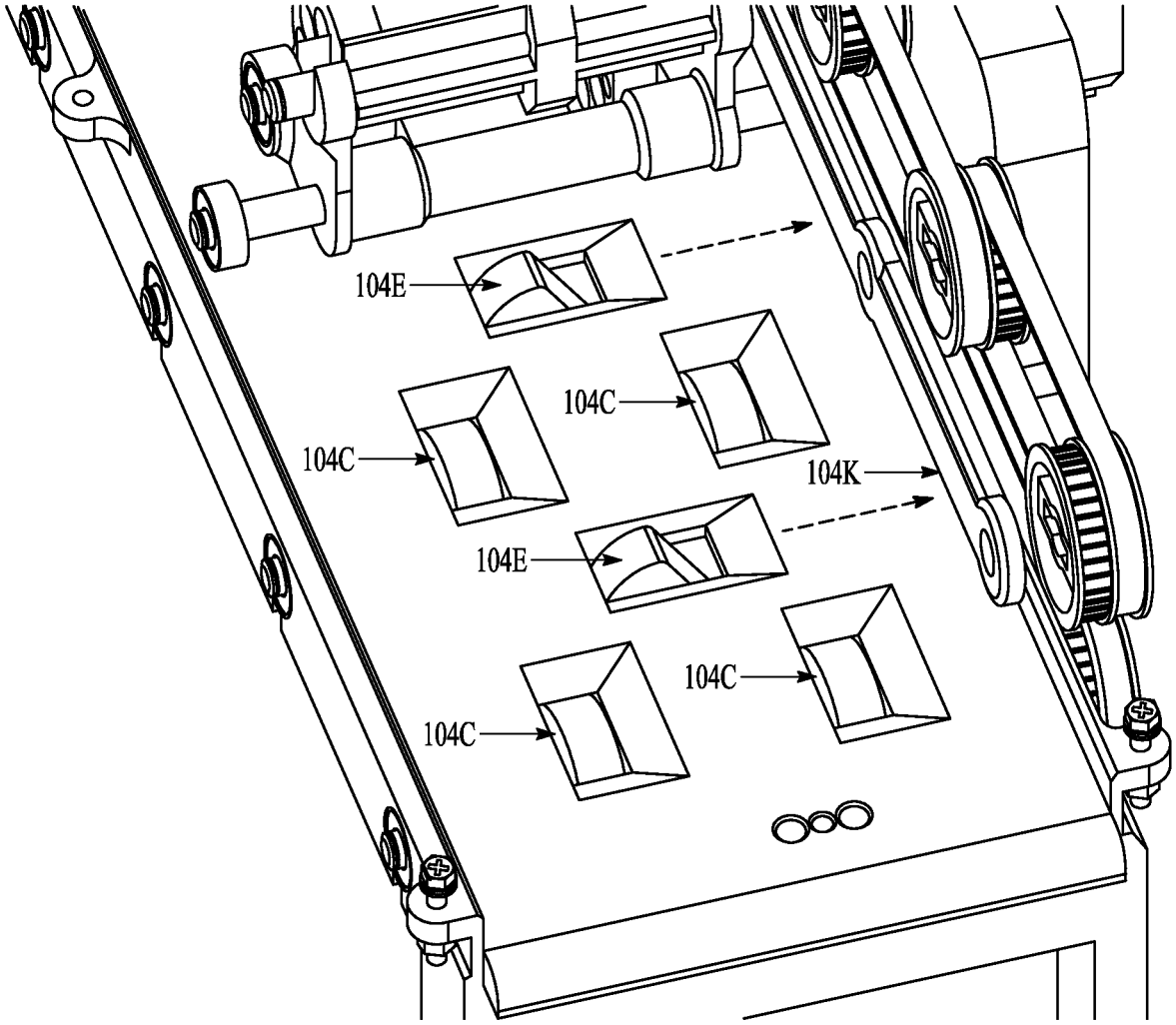
FIG. 1D is a diagram depicting a top-down view of the deskew module illustrating the D-shaped rollers in a partial rotation with the upper components removed from the deskew module, according to an example embodiment.

FIG. 1D is a diagram depicting a top-down view of deskew module 104 illustrating D-shaped rollers 104E in a partial rotation with upper rollers 104D removed from deskew module 104, according to an example embodiment.

Three D-shaped rollers 104E are shown in an initial and partial rotation in the direction of the three dotted arrows toward and perpendicular to sidewall 104K. Moreover, lower rollers 104C are shown recessed from the track surface (retracted) during rotation of D-shaped rollers 104E.

Figure 1E:
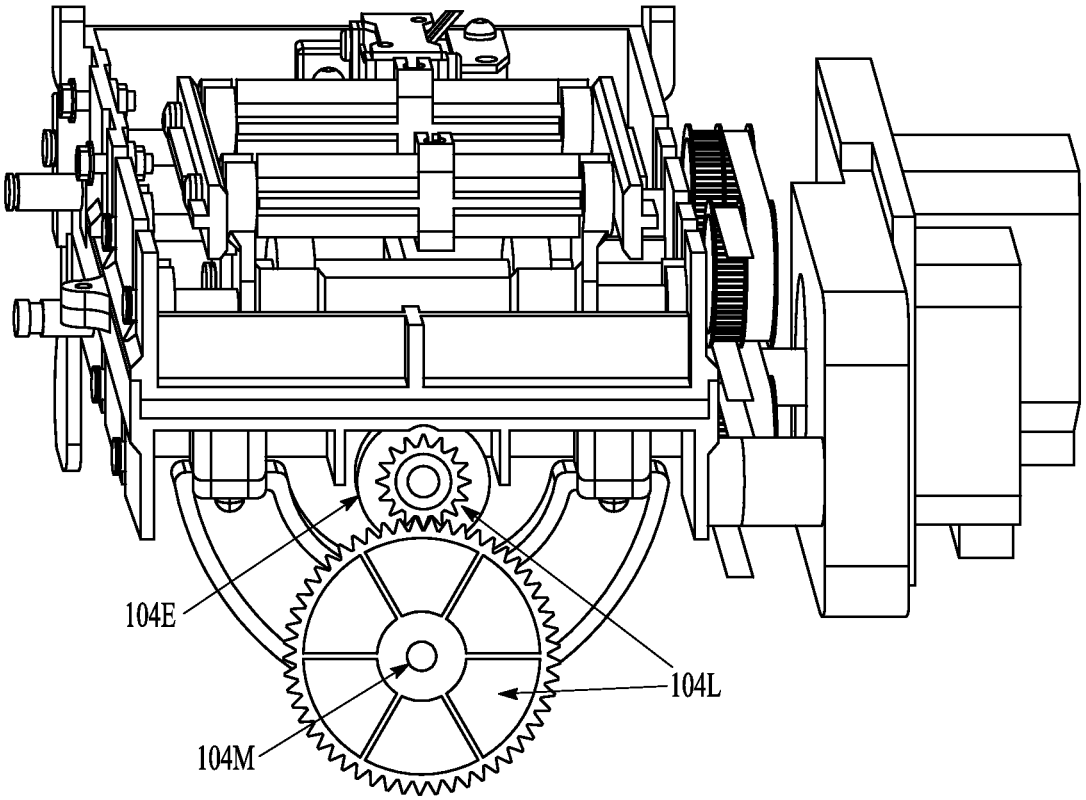
FIG. 1E is a diagram depicting a gear shaft and drive shaft of a D-shaped roller from a front cross-sectional view, according to an example embodiment.

FIG. 1E is a diagram depicting a gear arrangement 104L and drive shaft 104M of a D-shaped roller 104E from a front cross-sectional view, according to an example embodiment.

A single drive shaft 104M or axle engages three gear arrangements 104L (FIG. 1E illustrating on of the three) and is rotated causing each gear arrangement 104L to rotate each D-shaped roller 104E in unison and synchronization with the remaining D-shaped rollers 104E. Rotation is about the hole or aperture portion of the D-shaped rollers 104E and the direction is perpendicular to sidewall 104K (perpendicular to the direction of travel of the stack through deskew module 104).

Figure 1F:
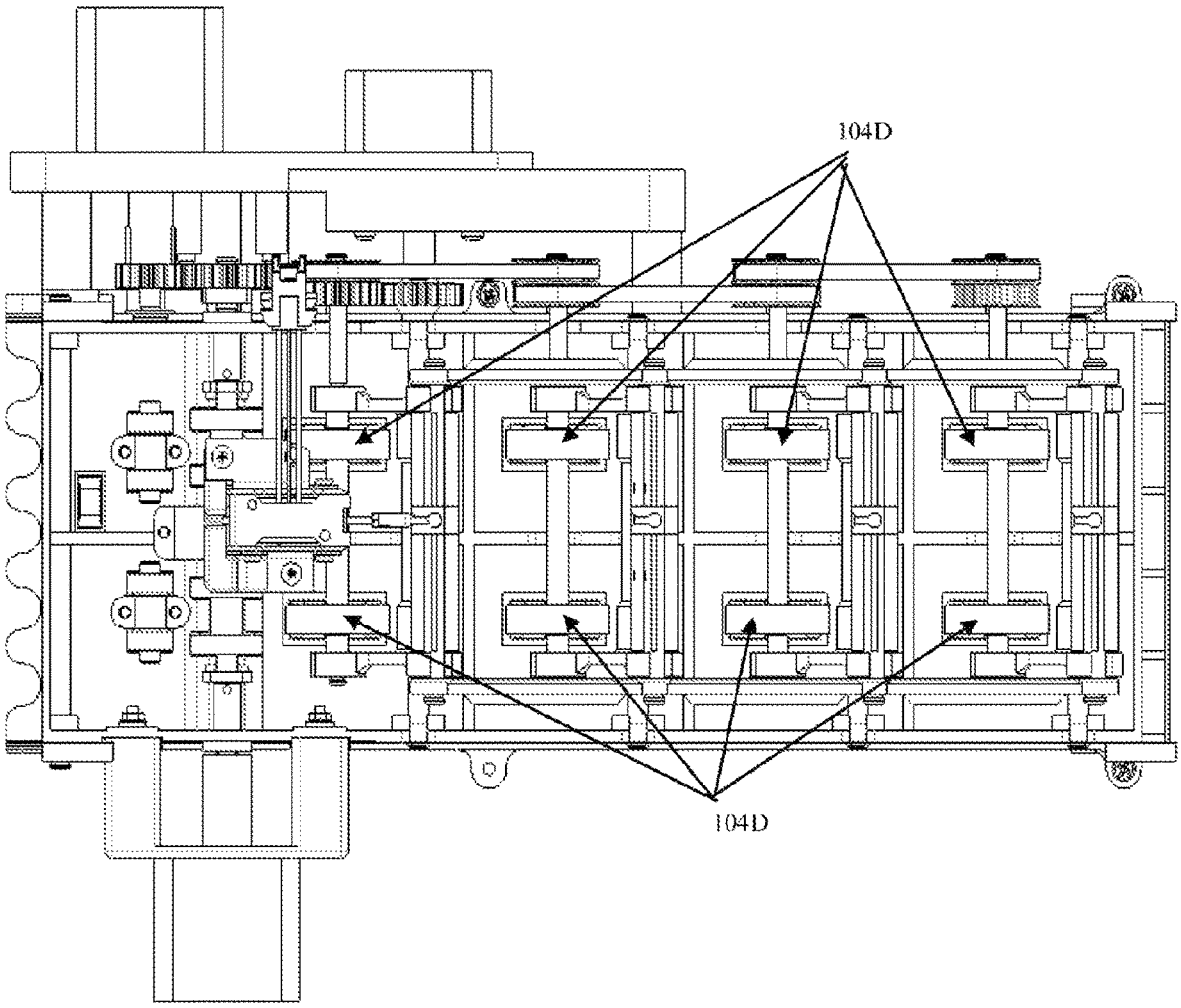
FIG. 1F is a diagram depicting the upper rollers of the deskew module from a top-down view, according to an example embodiment.

FIG. 1F is a diagram depicting upper rollers 104D of deskew module 104 from a top-down view, according to an example embodiment.

There are two sets of 4 upper rollers 104D, each set covering a portion of a width of the track surface.

Figure 1G:
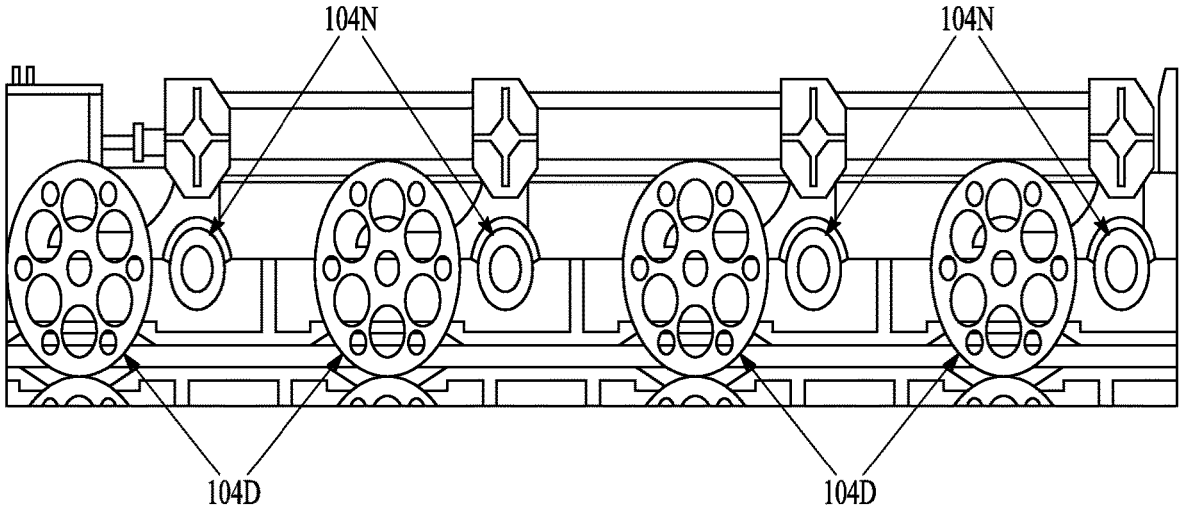
FIG. 1G is a diagram depicting pivot levers of the upper rollers of the deskew module with a side cross-sectional view, according to an example embodiment.

FIG. 1G is a diagram depicting pivot levers 104N of each upper roller 104D of deskew module 104 with a side cross-sectional view, according to an example embodiment.

Each upper roller 104D is constructed of a flexible material, such as silicone, which permits each roller 104D to bend or compress and flex when lowered and engaged on a topmost item of a stack. This applies downward pressure against the stack, keeping the stack firm and stable during transport from entry 104A to second track sensor 104F.

Upper rollers 104D are lifted and disengage a topmost item of the stack when the controller receives a signal that second track sensor 104F is covered by a bottommost media item of the stack. The pivot levers 104N lift upper rollers 104D up off the topmost item of the stack. This release the downward force and allows D-shaped rollers 104E to slip over outer edges of the stack during rotation.

Upper rollers 104D rotate when lower rollers 104C are rotating and rotate in the same direction from entry 104A towards exit 104J. When a bottommost item is being picked (separated) from the stack (after a full rotation of D-shaped rollers 104E), solenoid 104I lowers upper rollers 104D back onto a topmost item of the stack using levers 104N (upper rollers 104D are not rotating when lowered and do not rotate when fully lowered).

One now appreciates how both media separation and media deskewing can be achieved within a single novel deskew module 104. Deskew module 104 is less complex and requires less componentry than conventional deskew modules. Furthermore, deskew module 104 occupies substantially less track length than what is required by conventional deskew modules. The novel arrangement and shape of D-Shaped rollers 104E combined with novel upper rollers 104D permit deskew module 104 to handle a stack of media items and properly align or deskew at least a bottommost item of the stack (the media item picked or separated from the stack).

Notably, the track path upon which the media is transported or urged through deskew module 104 lacks or is devoid of any transport belt, which has conventionally been present and believed to be necessary. D-shaped rollers 104E are biased with the straight-line edge of the D-shape, which allows the media stack of media items to move unimpeded when pushed toward exit 104J by lower rollers 104C. Lower rollers 104C are recessed beneath the track path surface and raised and rotated in the direction of exit 104J to urge the stack towards exit 104J until a bottom media item is detected as covering second track sensor 104F. There is no transport belt mechanism to impede the D-shaped rollers 104E when the D-shaped rollers 104E are activated and rotated perpendicular to the movement of the stack through module 104 and perpendicular to sidewall 104K. Conventionally, this could not be achieved because a belt situated on top of the track surface would block direct contact of any lower rollers or drivers from engage the bottom item of the stack.

It is also to be noted, combined deskew/pick module 104 can process different sized media items (different lengths and/or widths) present in a stack of the media items as well as same sized media items present in a stack of the media items. Furthermore, the media items can be of different types within the stack (currency and checks) as well as a same type of media item within the stack.

In an embodiment, a traditional media separator's pick mechanism can be placed as an infeed to deskew module 104, such that deskew module 104 performs deskew or media alignment on a single media item; rather than a single media item located at a bottom of a stack of media items.

In an embodiment, a speed of rotation with which D-shaped rollers 104E are activated to rotate causing more than one media item in the stack to align against wall 104K, such that more than one pick of the media items can be achieved from the bottom of the stack before upper rollers 104D are raised off the topmost item of the stack and D-rollers 104E are rotated again. That is, because upper rollers 104D are disengaged from the top media item of the stack, the media items are able to be slammed by the speed and force of rotation of D-shaped rollers 104E against wall 104*k* in unison; this aligns more than just the bottom-most media item against sidewall 104K. In some cases, depending on whether each media item in the stack is of the same size (length and width) and, perhaps, the height of the stack (based on the number of media items in the stack), this process may be able to properly align all the media items in the stack, such that pick mechanism rollers 104H can be activated to serial pick each bottom media item from the stack without disengaging and lifting upper rollers 104D from the topmost item of the stack and without successively rotating D-shaped rollers 104E for each bottommost item picked from the stack.

Conventionally, the length of track surface believed necessary for the media separator (pick mechanism) and the deskew module was 530 mm based on a maximum sized media item of approximately 225 mm. The track length conventionally needed required two separate areas (picking and deskewing upon which to handle a note or at least 450 mm (to take from the bottom of the stack and feed to the deskew module)) plus an area for moving within the deskew module a single media item being deskewed angularly/diagonally. As a result, the length is approximately 530 mm. The present combined deskew module 104 and pick mechanism 104G, 104H, 104I, and 104J has a track length of approximately 316 mm. This is because the stack is processed during deskewing such that 225 mm (previously needed by the conventional media separator) can be dispensed with and because deskewing is achieved via perpendicular movement rather than diagonal movement. So, track associated with a conventional media separator is substantially reduced and track associated with deskewing is substantially reduced with the combined deskew module/pick module 104.

In an embodiment, the length of track required by the deskew module 104 can be configured based on a maximum sized media item being processed within depository 100.

In an embodiment, deskew module 104 includes 3D-shaped rollers 104E to account for a longest length of media item of approximately 225 mm and a shortest length of media item of approximately 127 mm. In an embodiment, the number of D-shaped rollers 104E can be reduced or increased based on the longer or shorter expected media item being processed through depository 100.

In an embodiment, the circumference of circular (rounded) portions of each D-shaped roller 104E is dependent upon is longer than the sideways movement required to push a smallest media item into wall 104K. In an embodiment, the narrowest media item is approximately 63.5 mm wide, the track width is 110 mm requiring a maximum movement of 46.5 mm, and the circumference of circular portions of each D-shaped roller 104E being 57 mm, which is 10.5 mm larger than a narrowest check (based on the maximum movement of 46.5 mm).

In an embodiment, depository 100 is integrated into an ATM.

In an embodiment, depository 100 is integrated into a Self-Service Terminal (SST) that handles valuable media deposits and dispenses valuable media for transactions.

In an embodiment, depository 100 is integrated into a Point-Of-Sale (POS) terminal that handles valuable media deposits and dispenses valuable media for transactions.

These and other embodiments will now be discussed with reference to FIGS. 2-4.

Figure 2:
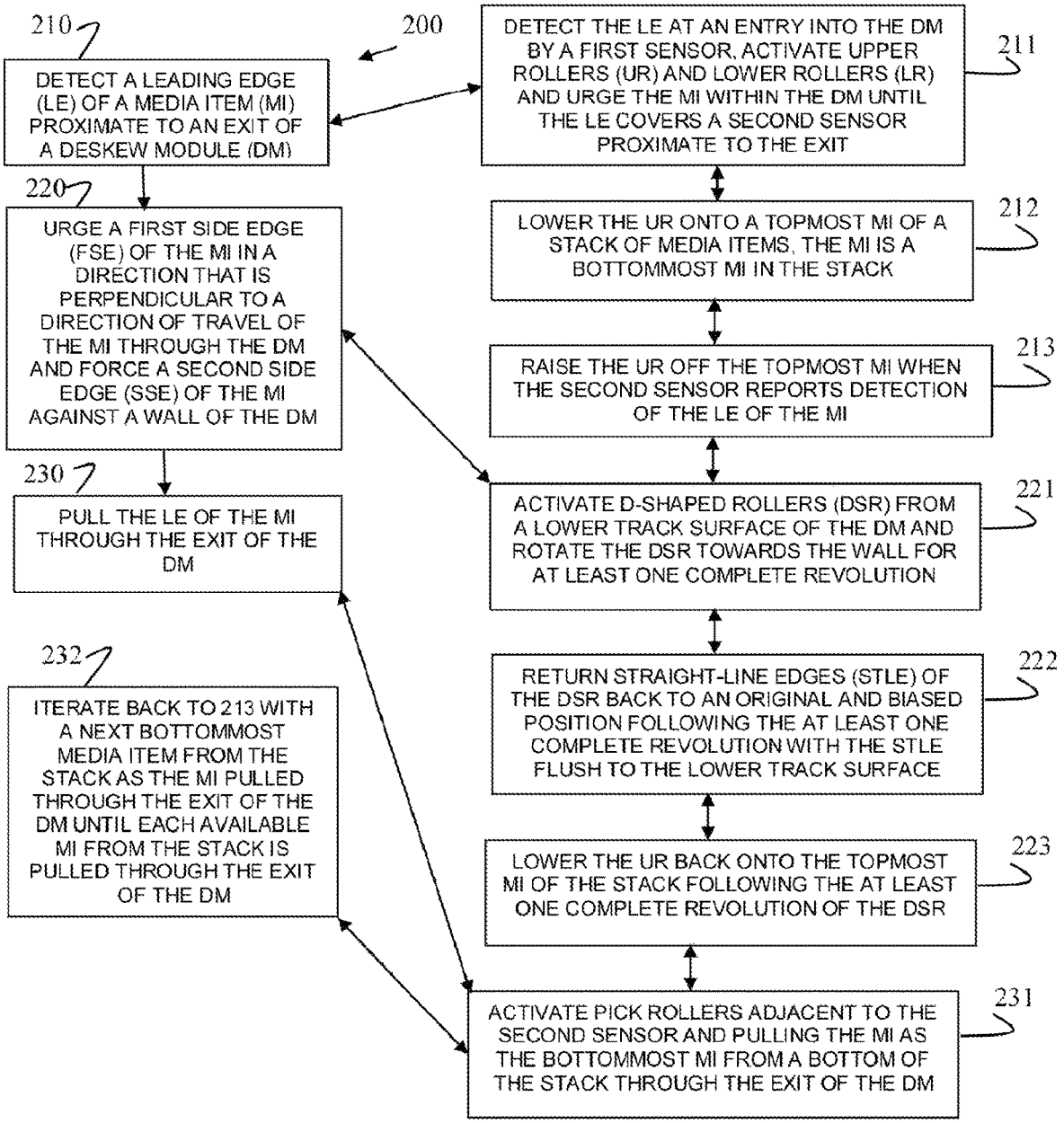
FIG. 2 is a diagram of a method for deskewing media, according to an example embodiment.

FIG. 2 is a diagram of a method 200 for deskewing media within combined deskew/pick module 104, according to an example embodiment. The method 200 when processed controls modes of operation for a deskew module 104 integrated into a valuable media depository 100. The method 200 is implemented as executed instructions representing one or more software modules referred to as a deskew controller. The instructions reside in a non-transitory computer-readable medium and are executed by one or more processors of the valuable media depository 100.

In an embodiment, a circuit board of depository 100 is connected to componentry of deskew module 104 and the circuit board includes a processor that executes the deskew controller from a non-transitory computer-readable storage medium of the circuit board.

In an embodiment, the media depository 100 is a deposit module.

In an embodiment, the media depository 100 is a recycler module.

In an embodiment, the media depository 100 is a peripheral device integrated into an SST. In an embodiment, the SST is an ATM. In an embodiment, the SST is a kiosk.

In an embodiment, the media depository 100 is a peripheral device integrated into a Point-Of-Sale (POS) terminal.

In an embodiment, the deskew controller receives signals (over a wired connection) from component elements of deskew module 100 and performs processing discussed above with the FIGS. 1B-1G to activate, deactivate, and selectively control elements of deskew module 100.

At 210 deskew controller detect a leading edge of a media item proximate to an exit of a deskew module. This can be done via a track sensor 104F that is adjacent to pick rollers 104H near the exit of the deskew module 104J or exit sensor 104G.

In an embodiment, at 211, the deskew controller detects the leading edge at an entry of the deskew module through a first or entry sensor 104B. The detection causes upper rollers 104D to activate and lower rollers 104C to activate, which urges the media item within the deskew module until the leading edge of the media item covers a second sensor 104F proximate to the exit.

In an embodiment of 211 and at 212, the deskew controller lowers the upper rollers 104D onto a topmost item of a stack of media items being processed through the deskew module. The media item is a bottommost item of the stack of media items.

In an embodiment of 212 and at 213, the deskew controller raises the upper rollers 104D off the topmost item when the second sensor 104F reports detection of the leading edge of the media item at the second sensor 104F.

At 220, the deskew controller urges a first side edge of the media item in a direction that is perpendicular to a direction of travel of the media item through the deskew module. This forces a second side edge (opposite the first side edge) of the media item against a wall of the deskew module and aligns the second side edge of the media item with the wall.

In an embodiment of 213 and 220, at 221, the deskew controller activates D-shaped rollers 104D from a lower track surface of the deskew module and rotates the D-shaped rollers 104D towards the wall of the deskew module for at least one complete revolution.

In an embodiment of 221 and at 222, the deskew controller returns straight-line (flat) edges or sides of the D-shaped rollers back to an original and biased position following the at least one complete revolution with the flat edges flush to the lower track surface.

In an embodiment of 222 and at 223, the deskew controller lowers the upper rollers 104D back onto the topmost item of the stack following the at least one complete revolution of the D-shaped rollers.

At 230, the deskew controller pulls the leading edge of the media item through the exit of the deskew module.

In an embodiment of 231 and 230, at 231, the deskew controller activates pick rollers 104H adjacent to the second sensor 104F and pulls the media item as the bottommost item from a bottom of the stack through the exit 104J of the deskew module (detectable through media exit sensor 104G).

In an embodiment of 231 and at 232, the deskew controller iterates back to 213 with a next bottommost media item from the stack as the media item pulled through the exit 104J of the deskew module until each available or all of the available media items in the stack are pulled and processed through the exit 104J of the deskew module.

It is noted that the deskew controller can be processed in one embodiment (discussed beginning at embodiment 212) to deskew media items from a stack or bunch of media items. However, in some embodiments, the deskew controller can be processed on a single media item. In this way, the pick mechanism can either be situated at the front of the deskew module (for single media item deskewing) or situated after the deskew module (for single item deskewing on a stack).

Figure 3:
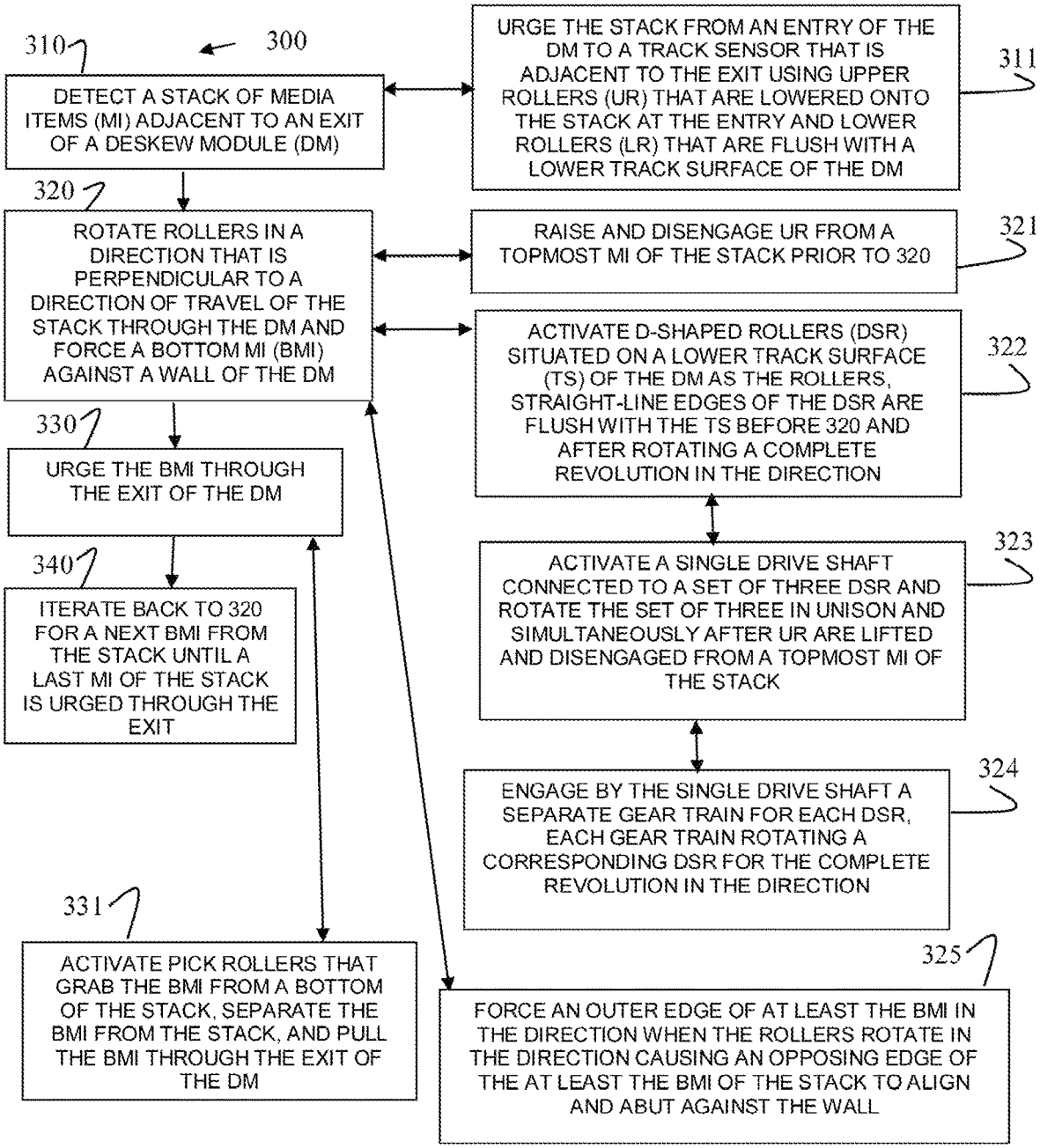
FIG. 3 is a diagram of another method for deskewing media, according to an example embodiment.

FIG. 3 is a diagram of another method 300 for deskewing media within a combined deskew/pick module 104 of a depository 100, according to an example embodiment. The method 200 when processed controls electro mechanical elements/components of module 104. The method 200 is implemented as executed instructions representing one or more software modules referred to as a media bunch deskewer and picker. The instructions reside in a non-transitory computer-readable medium and are executed by one or more processors of the valuable media depository.

In an embodiment, the media bunch deskewer and picker is executed by one or more processors of the valuable media depository 100.

That is, a circuit board of depository 100 includes wired connections to elements/components of module 104. Signals are received from elements over the wired connections and a processor of the circuit board executes the media bunch deskewer and picker from a non-transitory medium of the circuit board. This causes the processor to send control signals that selectively activate, control, and deactivate the elements/components of module 104 to perform processing discussed above with the FIGS. 1B-1G and/or method 200 of FIG. 2.

In an embodiment, the media depository 100 is a deposit module.

In an embodiment, the media depository 100 is a recycler module.

In an embodiment, the media depository 100 is a peripheral device integrated into an SST. In an embodiment, the SST is an ATM. In an embodiment, the SST is a kiosk.

In an embodiment, the media depository 100 is a peripheral device integrated into a POS terminal.

In an embodiment, the media bunch deskewer and picker is the controller and/or the deskew controller discussed above with the FIGS. 1B-1G and the FIG. 2.

In an embodiment, the media bunch deskewer and picker presents another and, in some ways, enhance perspective of the processing depicted in the method 200 (presented above with the discussion of the FIG. 2 and the deskew controller).

At 310, the media bunch deskewer and picker detects a stack of media items adjacent to an exit of a deskew module.

In an embodiment, at 311, the media bunch deskewer and picker urges the stack from an entry 104A of the deskew module 100 to a track sensor 104F adjacent to the exit using upper rollers 104D that are lowered onto the stack at the entry 104A and lower rollers 104C that are flush with a lower track surface of the deskew module 100.

At 320, the media bunch deskewer and picker rotates rollers 104E in a direction that is perpendicular to a direction of travel of the stack through the deskew module 100 and force a bottom media item against a wall of the deskew module 100.

In an embodiment, at 321, the media bunch deskewer and picker raises and disengages upper rollers 104D from a topmost item of the stack prior to rotating the rollers at 320.

In an embodiment, at 322, the media bunch deskewer and picker activates D-shaped rollers 104E situated on a lower track surface of the deskew module 100 as the rollers that are rotated. Straight-line (flat) edges or sides of the D-shaped rollers 104E are flush with the track surface before 320 and after rotating a complete revolution in the direction.

In an embodiment of 322 and 323, the media bunch deskewer and picker activates a single drive shaft connected to a set of three D-shaped rollers 104E and rotates the set of three in unison and simultaneously after the upper rollers 104D are lifted and disengaged from the topmost item of the stack.

In an embodiment of 323 and at 324, the single drive shaft engages a separate gear train for each D-shaped rollers 104E. Each gear train rotates a corresponding D-shaped rollers 104E for the complete revolution in the direction.

In an embodiment, at 325, the media bunch deskewer and picker forces an outer edge of at least the bottom media item in the direction when the rollers rotates in the direction causing an opposing edge of the bottom media item of the stack to align and abut against the wall.

At 330, the media bunch deskewer and picker urges the bottom media item through the exit of the deskew module.

In an embodiment, at 331, the media bunch deskewer and picker activates pick rollers 104H that grab the leading edge of the bottom media item of the stack, separates the bottom media item from the stack, and pulls the bottom media item through the exit 104J of the deskew module 100.

At 340, the media bunch deskewer and picker iterates back to 320 for a next bottom media item from the stack. This process continues until a last media item of the stack is urged through the exit of the deskew module.

Figure 4:
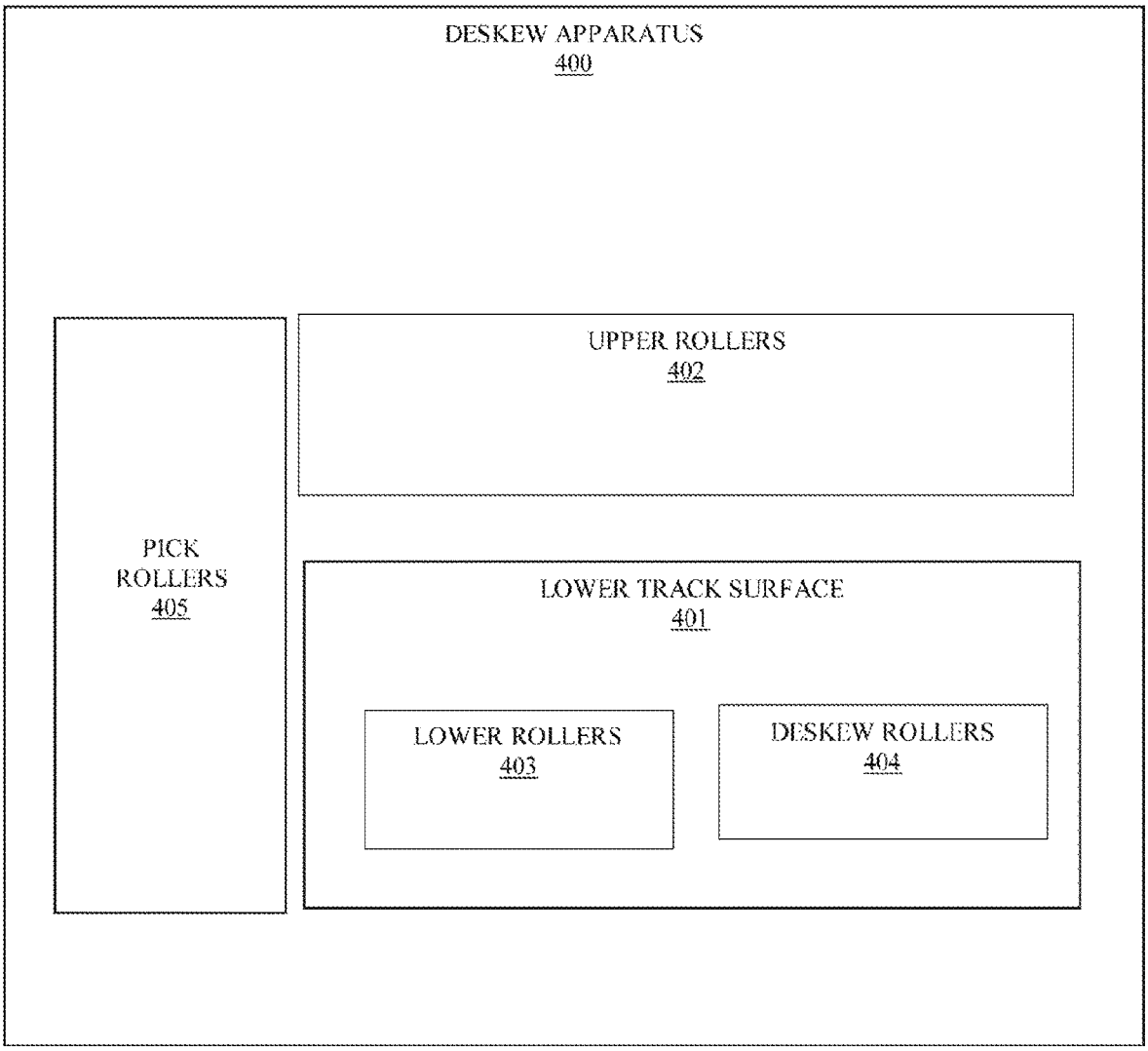
FIG. 4 is a deskew module, according to an example embodiment.

FIG. 4 is a deskew module 400, according to an example embodiment. The deskew module 400 is integrated within valuable media depository 400 processes valuable media and includes a variety of mechanical, electrical, and software/firmware components, some of which were discussed above with reference to the FIGS. 1A-1G and the FIGS. 2-3.

In an embodiment, the valuable media depository 400 is a deposit module.

In an embodiment, the valuable media depository 400 is a recycler module.

In an embodiment, the valuable media depository 400 is the depository 100.

In an embodiment, the valuable media depository 400 is the depository that performs any of the methods 150, 200, and 300 of the FIGS. 1H and 2-3.

In an embodiment, the valuable media depository 400 is a peripheral device integrated into an SST. In an embodiment, the SST is an ATM. In an embodiment, the SST is a kiosk.

In an embodiment, the valuable media depository 400 is a peripheral device integrated into a POS terminal.

The deskew module 400 is combined deskew/pick module 104. Components/elements of deskew module 400 are controlled over wired circuitry within depository 100 by a controller that is executed by a processor of a circuit board within the depository 100 from a non-transitory computer-readable storage medium. The controller performs processing discussed above with the FIGS. 1B-1G, 2, and 3 to selectively control, activate, and deactivate the components/elements of deskew module 400.

Deskew module 400 includes a lower track surface 401, upper rollers 402, lower rollers 403, deskew rollers 404, and pick rollers 405.

The upper rollers 402 are oriented and situated above the lower track surface 401. The lower rollers 403 are recessed in a biased position beneath first portions of the lower track surface 401. The deskew rollers 404 are recessed beneath second portions of the lower track surface 401 in a biased position. It is to be noted that the first portions and the second portions are intermixed with one another, such that a single deskew roller 404 is situated between sets of the lower rollers 403 as is depicted in FIG. 1D above. Thus, the first portions and second portions are non-contiguous portions within the lower track surface 401. The pick rollers 405 are situated and adjacent to an exit of the deskew apparatus 400.

The upper rollers 402 are configured to lower onto a topmost item of a stack of media items upon detection a bottommost item of the stack at an entry sensor into the deskew apparatus 400. The lower rollers 403 are configured slightly under flush with the lower track surface 401 upon entry of the bottommost item of the stack into the deskew apparatus 400. Furthermore, the upper rollers 402 and the lower rollers 403 are configured to rotate in a first direction towards an exit of the deskew apparatus 400 upon entry of the bottommost item of the stack into the deskew apparatus 400 to urge the stack towards the exit of the deskew apparatus 400.

The upper rollers 401 and the lower rollers 403 are configured to stop rotating in the first direction when the bottommost item is detected at a second sensor adjacent to the pick rollers 405, at which point the upper rollers 402 are configured to raise off of the topmost item when the bottommost item is detected at the second sensor.

The deskew rollers 404 are configured to make a complete revolution and rotate in a second direction that is perpendicular to the first direction when the upper rollers 402 and the lower rollers 403 stop rotating to cause the bottommost item to align against a wall of the deskew apparatus 400. At this point, the upper rollers 402 are configured to lower back onto the topmost item of the stack without rotation after the complete revolution of the deskew rollers 404.

The pick rollers 405 are configured to activate after the upper rollers 402 are lowered back onto the topmost item of the stack to grab the bottommost item from the stack and pull the bottommost item through the exit. Next, the upper rollers 402 are configured to raise off the topmost item of the stack upon detection of the bottommost item passing over an exit sensor.

The deskew apparatus 400 is configured to iterate back to rotation of the deskew rollers 404 until a last item of the stack is pulled through the exit by the pick rollers 405.

A controller receives wired signals from the sensors and sends instructions to the rollers 402-405 to activate and to deactivate. The controller is a set of executable instructions residing in a non-transitory computer-readable medium that are executed by a processor of a circuit board. The circuit board is integrated into depository 100. In an embodiment, the circuit board may reside on the deskew apparatus 400 in such case other executable instructions executed on processors of the depository 100 interact with the circuit board of the deskew apparatus 400.

The above description is illustrative, and not restrictive. Many other embodiments will be apparent to those of skill in the art upon reviewing the above description. The scope of embodiments should therefore be determined with reference to the appended claims, along with the full scope of equivalents to which such claims are entitled.

In the foregoing description of the embodiments, various features are grouped together in a single embodiment for the purpose of streamlining the disclosure. This method of disclosure is not to be interpreted as reflecting that the claimed embodiments have more features than are expressly recited in each claim. Rather, as the following claims reflect, inventive subject matter lies in less than all features of a single disclosed embodiment. Thus, the following claims are hereby incorporated into the Description of the Embodiments, with each claim standing on its own as a separate exemplary embodiment.

The invention claimed is:

1. A method, comprising:

detecting a stack of media items adjacent to an exit of a deskew module;

rotating rollers in a direction that is perpendicular to a direction of travel of the stack through the deskew module and forcing a bottom media item of the stack in alignment against a wall of the deskew module, wherein rotating further includes raising and disengaging upper rollers from a topmost media item of the stack prior to the rotating of the rollers;

urging the bottom media item through the exit of the deskew module; and iterating back to the rotating for a next bottom media item until a last media item of the stack is urged through the exit.

2. The method of claim 1, wherein detecting further includes urging the stack from an entry of the deskew module to a track sensor that is adjacent to the exit using the upper rollers that are lowered onto the stack at the entry and lower rollers that are flush with a lower track surface of the deskew module.

3. The method of claim 1, wherein rotating further includes forcing an outer edge of at least the bottom media item in the direction when the rollers rotate in the direction causing an opposing edge of the at least the bottom item of the stack to align and abut against the wall.

4. The method of claim 1, wherein urging further includes activating pick rollers that grab the bottom media item from a bottom of the stack, separate the bottom media item from the stack, and urge the bottom media item through the exit of the deskew module.

5. A method comprising:

detecting a stack of media items adjacent to an exit of a deskew module;

rotating rollers in a direction that is perpendicular to a direction of travel of the stack through the deskew module and forcing a bottom media item of the stack in alignment against a wall of the deskew module, wherein rotating further includes activating D-shaped rollers situated on a lower track surface of the deskew module as the rollers, wherein straight-line edges of the D-shaped rollers are flush with the lower track surface before rotating and after rotating a complete revolution in the direction, wherein rotating further includes activating a single drive shaft connected to a set of three of the D-shaped rollers and rotating the set of three in unison and simultaneously after upper rollers are lifted and disengaged from a topmost media item of the stack;

urging the bottom media item through the exit of the deskew module; and iterating back to the rotating for a next bottom media item until a last media item of the stack is urged through the exit.

6. The method of claim 5, wherein activating a single drive shaft further includes engaging by the single drive shaft a separate gear train for each D-shaped roller, each gear train rotating a corresponding D-shaped roller the complete revolution in the direction.

* * * * *